US005636483A

United States Patent [19]

Wille

[11] Patent Number: 5,636,483

[45] Date of Patent: Jun. 10, 1997

[54] ADJUSTABLE STAIRSTEP SYSTEM AND PROCESS OF ASSEMBLING AND INSTALLING SAME

[75] Inventor: Timothy G. Wille, Canton, Ga.

[73] Assignee: Quick-Flight Stair Co., Inc., Alpharetta, Ga.

[21] Appl. No.: 440,634

[22] Filed: May 15, 1995

Related U.S. Application Data

[63] Continuation-in-part of Ser. No. 161,756, Dec. 3, 1993, abandoned.

[51] Int. Cl.[6] ..... E04F 11/00

[52] U.S. Cl. ..... 52/188; 52/183; 182/228

[58] Field of Search ..... 52/182, 183, 188, 52/190, 741.2; 248/542, 544; 182/18, 228

[56] References Cited

U.S. PATENT DOCUMENTS

| | | | |
|---|---|---|---|
| 3,470,664 | 10/1969 | Whitehead . | |
| 3,713,511 | 1/1973 | Hinkle | 52/182 X |
| 3,885,365 | 5/1975 | Cox | 52/183 |
| 3,962,838 | 6/1976 | Cox | 52/183 |
| 4,406,347 | 9/1983 | Stathopoulos | 52/183 X |
| 4,457,398 | 7/1984 | Loix | 182/228 X |
| 4,593,503 | 6/1986 | Koslowski | 52/182 X |
| 4,615,160 | 10/1986 | LeBlond | 52/183 |
| 4,959,935 | 10/1990 | Stob | 52/183 |
| 5,189,854 | 3/1993 | Nebel | 52/183 |

*Primary Examiner*—Creighton Smith
*Attorney, Agent, or Firm*—Isaf, Vaughan & Kerr

[57] ABSTRACT

A prefabricated stair system having individually pivotally mounted right angular brackets on opposed stringers, has a control bar which removably contacts the brackets to assume all brackets are arranged at the same angles with respect to the stringer so that the treads, which are supported by opposed pairs of brackets, are parallel to the floors and the risers supported by the brackets are perpendicular to the treads. The stair system is shipped as a kit and assembled in situ following a method of assembly and installation.

30 Claims, 6 Drawing Sheets

ADJUSTABLE STAIRSTEP SYSTEM AND PROCESS OF ASSEMBLING AND INSTALLING SAME

This is a continuation-in-part application of Ser. No. 08/161,756 filed Dec. 3, 1993, now abandoned.

FIELD OF INVENTION

This invention relates to an adjustable stair and is more particularly concerned with an adjustable stair system, a kit therefore, and a method of assembling and installing the same.

BACKGROUND OF THE INVENTION

In the past, many adjustable stairs have been devised. Several of these involve complex metal steps with pairs of stringers on both sides of the steps, one stringer of each pair being movable with respect to the other stringer so as to position the steps in horizontal positions in the stairwell. Usually, in such an arrangement, both stringers on both sides of the stair are secured flat against the opposed wall to retain the steps in horizontal positions. The patent to J. I. Whitehead U.S. Pat. No. 3,470,664 is an example of such a structure.

BRIEF DESCRIPTION OF THE INVENTION

Briefly described, the present invention includes a stair system which can be shipped in kit form in a knocked-down condition and readily and easily assembled on the job. In more detail, the stair system of the present invention, when assembled, includes a pair of opposed complimentary single piece stringers, each of which is provided with a plurality of equally spaced right angular metal brackets pivoted at their apexes, so that each bracket provides a rearwardly extending surface for receiving an end of the prefabricated horizontal tread and a downwardly extending surface for receiving an end of the vertically disposed riser. The risers are usually wider than the height between treads so that, when the kit is assembled, the inner edge of a tread abuts an intermediate portion of the riser and the upper edge of the riser abuts flat against the lower flat surface of the tread.

In the first embodiment, each bracket is initially pivotally mounted against the inside surface of its associated stringer by a pivot pin, the pivot pin received in an apex portion adjacent to the apex of the right angular bracket. The axes of the pivot pins are equally spaced by a prescribed distance from each other along a line parallel to the outer edge of the stringer and each bracket is free to rotate about the axis of its pivot pin. Disposed at the distal end of one arm of each bracket is a socket hole, the axis of which is parallel to the axis of the pivot pin, the socket of each bracket being spaced from the pivot pin by the same prescribed distance.

For the purpose of adjusting all brackets, simultaneously, an adjustment or control rod or bar is provided, which has a plurality of equally spaced fingers, each protruding in cantilever fashion perpendicularly from the bar. The axis of each finger is spaced from the next adjacent finger by a distance equal to the distance between axes of adjacent pivot pins. The fingers are adapted to be inserted respectively into the socket holes of the brackets, only when all brackets are in the same angular position with respect to the stringer to which they are attached. Thus, by manipulation of the control bar, once the fingers have been respectively inserted into their socket holes, the brackets are caused to pivot simultaneously, so as to dispose the surface of all tread supporter flanges of the brackets of one stringer to be in horizontal positions to conform to the desired incline of the stringer.

The brackets are provided with the holes, spaced from the pivot pins, so that when bolts or screws are passed through these holes and into the associated stringer, the angular position of the respective brackets are fixed with respect to their stringer. When the angle of the uppermost bracket is fixed, the upper end portion of the stringer is cut at a right angle to the tread support flange on the uppermost bracket and when the lowermost bracket is fixed, the lower portion of the stringer is cut at an appropriate distance from and parallel to the surface of the tread flange of the lowermost bracket. The stringer for one side is used to cut the complimentary stringer for the other side. When both stringers are cut, the risers are then installed on the brackets and then the treads are installed, except the uppermost tread, abutting its adjacent riser. Screws are installed from the rear of the system, one step at a time, to secure the risers and treads in place. If access to the rear of the risers is not practical, the uppermost riser and step can be installed by screws from the front.

In the second embodiment, the stringers are rectangular, symmetrical members, formed from plywood, having preferably a paint grade flat surface and a stain grade flat surface for the opposed side surfaces, so that, by selecting the appropriate surface of the stringers to each other, the completed staircase can be painted or stained, as desired.

Aligned longitudinally extending, equally spaced, rows of holes in the stringers enable each stringer to be used as a left hand or fight hand stringer and used for producing stairs having different length hypotenuses.

The brackets of the second embodiment are triangular, being preferably formed from wood, plywood or particle board and each is provided with a pivot pin at its apex portion and a hole spaced from the pivot pin. The pin can protrude sidewise selectively on one side or the other, or from both sides of the bracket.

Also, the pivot pin protruding from both sides of the apex of the bracket enables the bracket to be used on a stringer on the left hand or right hand side of the stair.

The control rod for the second embodiment has a row of equally spaced fingers protruding sidewise from one side surface of the rod and a second row of equally spaced rods along a circumferentially spaced surface, whereby the rods of one row can be for manipulating brackets of one hypotenuse spacing and the other row used for manipulating brackets with different hypotenuse spacing.

Accordingly, it is an object of the present invention to provide a stair system which can be prefabricated at a plant, shipped in a knocked-down or partially pre-assembled condition and adjusted to the stairwell on site, quite readily and easily.

Another object of the present invention is to provide a stair system and kit which is inexpensive to manufacture, durable in structure and easy to assemble using conventional carpenter tools.

Another object of the present invention is to provide a stair system, the inclination of which can be adjusted so as to conform to the space between floors and fit accurately into a stairwell.

Another object of the present invention is to provide a process of assembling and installing a stair in a stairwell quite easily and rapidly.

Another object of the present invention is to provide a stringer for a stair kit which can be prefabricated and can be readily and easily assembled with a complimentary stringer, treads and risers at the site to fit into a variety of stairwells.

Another object of the present invention is to provide a simple yet efficient method of producing a stair system within a prescribed stairwell.

Other objects, features and advantages of the present invention will become apparent from the following description when considered in conjunction with the accompanying drawings wherein like characters of reference designate corresponding parts throughout the several views.

DETAILED DESCRIPTION OF THE PREFERRED EMBODIMENT

Referring now in detail to the embodiment chosen for the purpose of illustrating the present invention, numeral 10 denotes a left hand stringer of the first embodiment of the stair system of the present invention. The stringer 10 is initially a flat rectangular, unitary or one piece plate or board of uniform width throughout its length and usually of a length greater than the inclined length of the stairwell in which it is to be used. The stringer 10 is preferably formed of laminated veneered lumber in which the central core 10*a* is of cross-grained wood laminate and the inner and outer, flat, parallel surfaces 10*b* and 10*c* are respectively sheets of plastic, the three layers being adhered together as a laminate using heat, pressure and adhesive, thus affording excellent resistance to moisture. It is desirable that the layers 10*b* and 10*c* be provided with smooth outer surfaces for reasons to be explained hereinafter. Such laminated boards are particularly desirable for forming the stringers 10 and 20 because they are dimensionally stable and are usually of uniform thickness with flat, opposed, parallel, inner and outer surfaces 10*b*, 10*c*, 20*b*, 20*c*. Furthermore, such boards are quite uniform in their thickness throughout their length and do not readily warp due to their resistance to moisture. Thus, kits, from which the stair system of the first embodiment is produced, can be prefabricated with uniformity.

Figure 2:
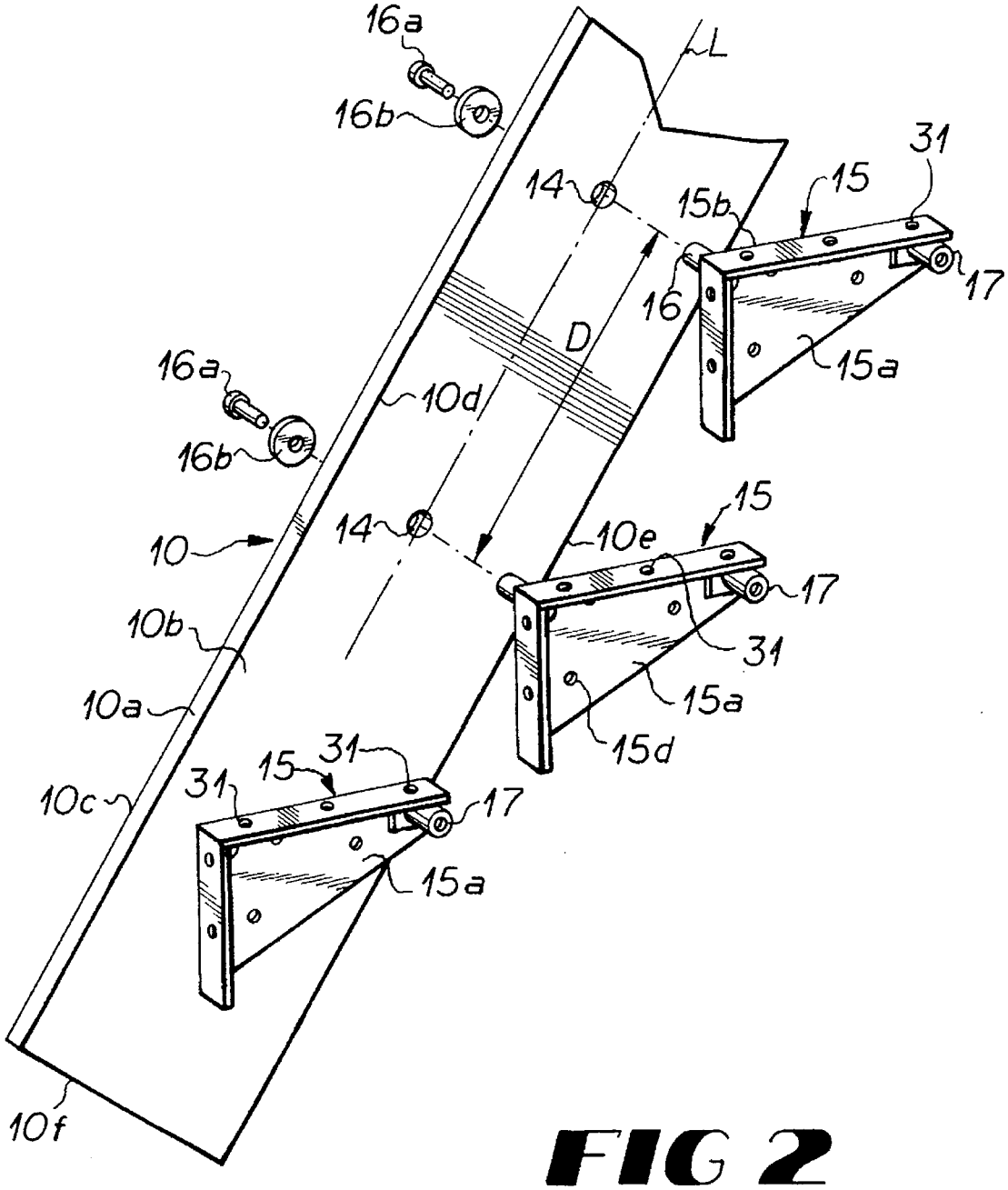
FIG. 2 is an exploded perspective view of a portion of one of the stringers of the stair system of the first embodiment of the invention, depicted in FIG. 1, together with its brackets and pivot pins.

The stringer 10, as shipped, is rectangular, having a front side edge 10*d* which is straight throughout its length and a straight rear edge 10*e* parallel to front edge 10*d*. As initially produced and shipped, both ends of the stringer 10, such as end 10*f* in FIG. 2, are straight along the upper and lower ends of stringer 10 and perpendicular to the parallel edges 10*d* and 10*e*. The stringer 10 will later be cut, on site, to an appropriate condition to provide the bottom edge 11, the front edge 12, and rear edge 52, as will be explained hereinafter.

Figure 1:
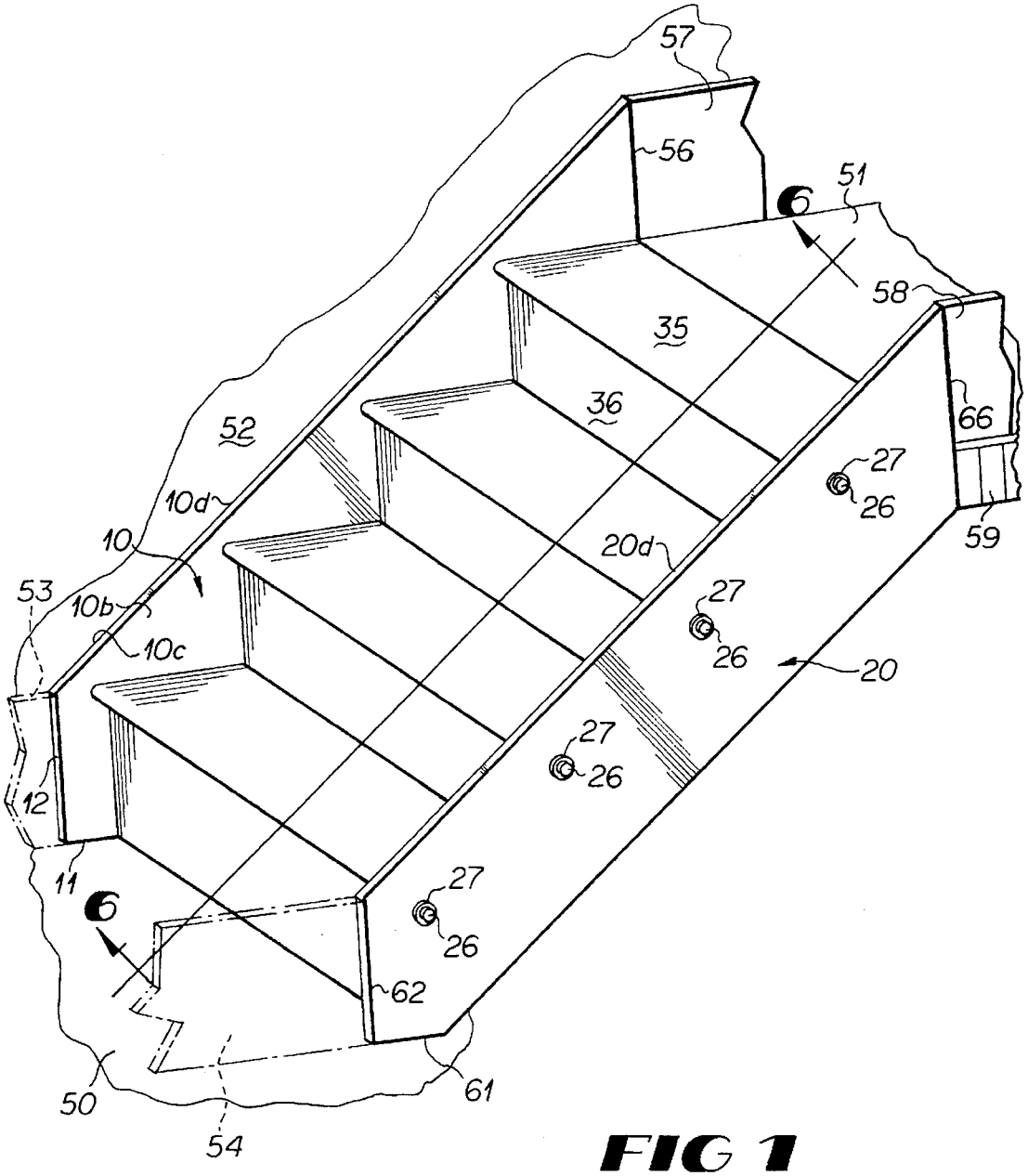
FIG. 1 is a fragmentary perspective view of a portion of the stair system constructed in accordance with the present invention and installed within a stairwell, the stairwell being shown in broken lines.

The opposite stringer 20 is complementary to the stringer 10 so that when the stair system is completed, as illustrated in FIG. 1, the inner surfaces of stringers 10 and 20, such as surface 10*b*, are facing each other, the two stringers 10 and 20 being in parallel planes with their respective front edges 10*d* and 20*d* disposed in a common transverse inclined plane.

As best seen in FIG. 2, the stringers, such as stringer 10, are provided with a plurality of equally spaced, longitudinally aligned pivot holes, such as holes 14, which respectively receive and journal pivot pins 16 which protrude respectively from tread/riser support brackets 15. The axes of holes 14 are along a straight line L which is parallel to and inward of front side edge 15*d* and rear edge 15*e*.

Figure 3:
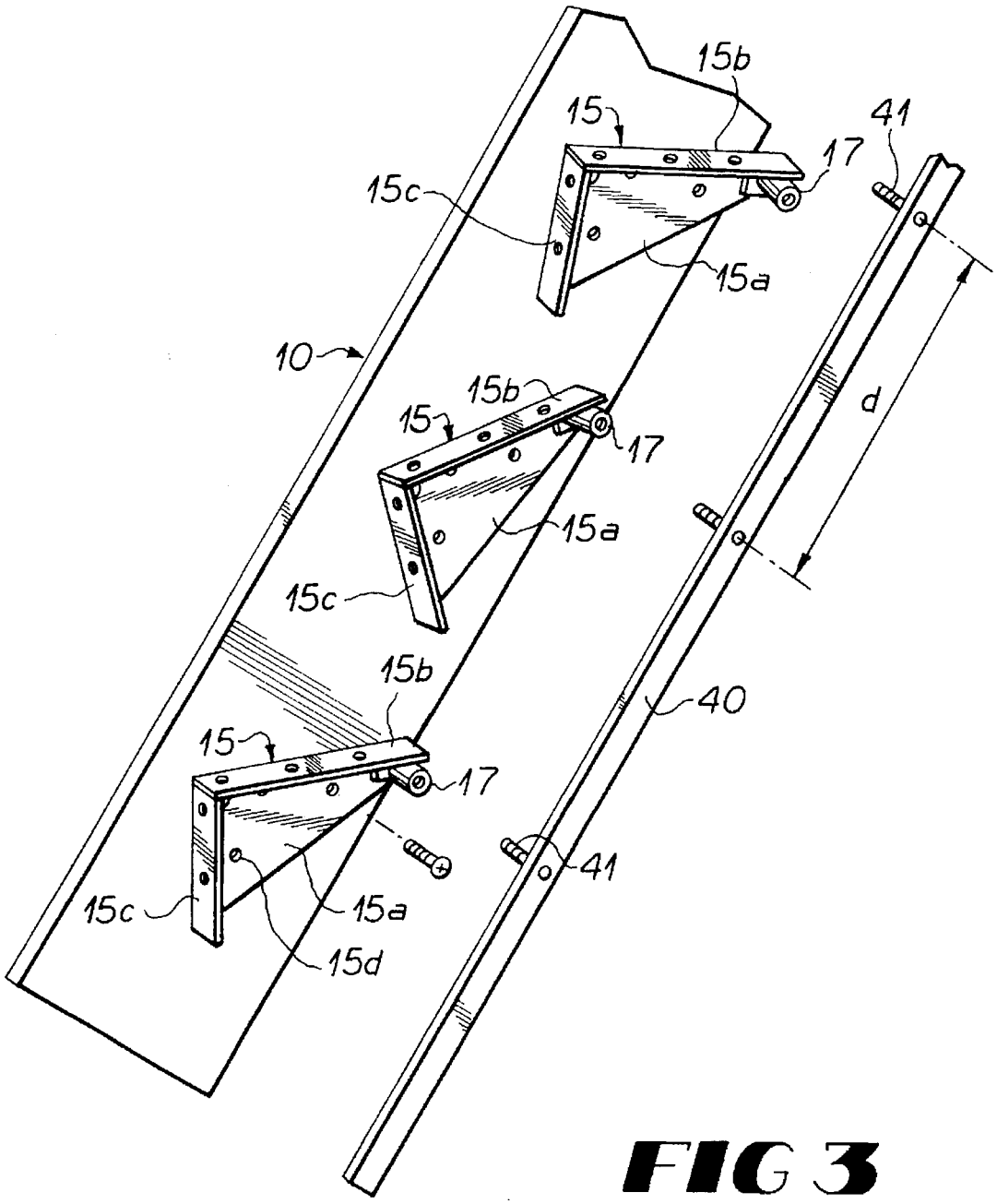
FIG. 3 is a perspective view of that portion of the stringer and brackets depicted in FIG. 1, illustrating the brackets installed on the stringer and the control bar being disposed adjacent to the brackets.
Figure 4:
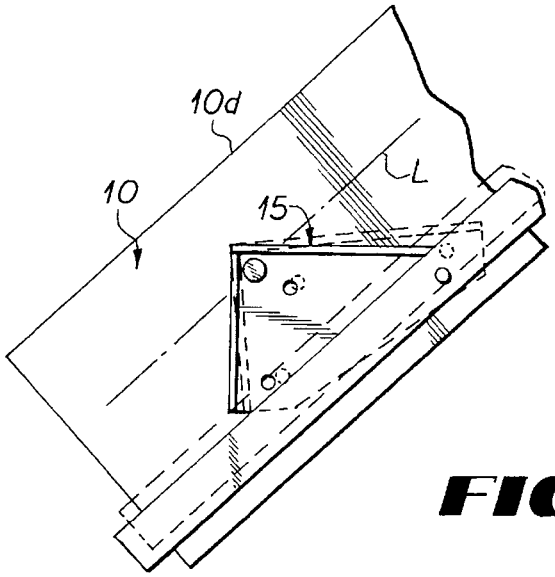
FIG. 4 is a fragmentary side elevational view of a portion of one of the stringers of the stair system depicted in FIG. 1, and showing in broken lines a pivoted position of the bracket.
Figure 5:
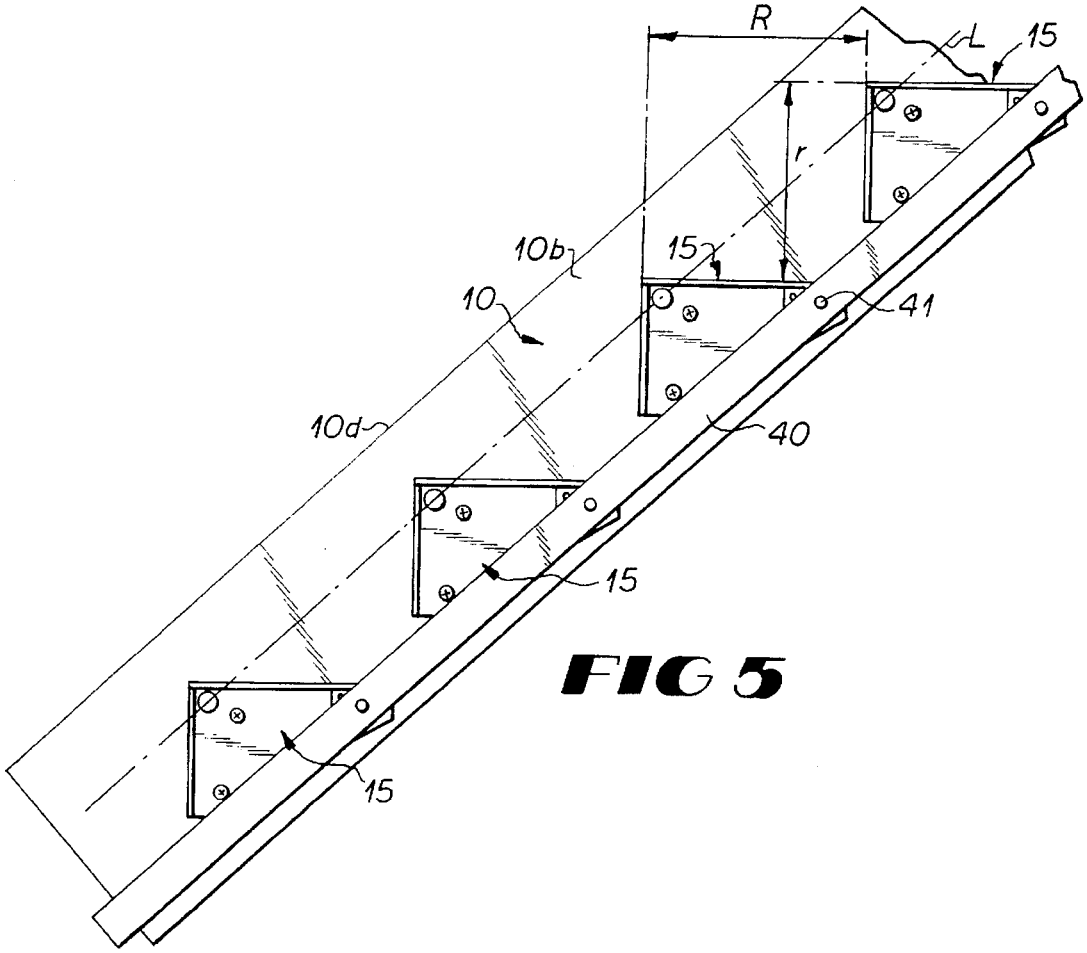
FIG. 5 is a side elevational view of a portion of the stringer depicted in FIGS. 2, 3 and 4 with the control bar installed for simultaneous angular adjustment of the brackets.

Each tread/riser support bracket 15 of the first embodiment is preferably formed of sheet metal or injection molded resin which is formed into the configuration shown in FIGS. 2 and 3. Thus, each bracket 15 has a flat web or body 15*a*, a tread support flange 15*b* and a riser support 15*c*. The tread support flange 15*b* is integrally formed by the bracket being inwardly turned or bent along one edge of web 15*a* to dispose the flange 15*b* at 90° to web 15*a*. Riser support flange 15*c* is similarly formed, the riser support flange 15*b* being perpendicular to both the flat web 15*a* and the tread support 15*b*. When the two supports or flanges 15*b* and 15*c* are turned perpendicular to the web 15*a*, their abutting ends are fastened together so as to form a common apex 15e, and so that the tread support flange 15*b* and the riser support flange 15*c* are always perpendicular to each other and extend away from web 15*a* in a direction opposite to that of the pivot pin 16.

Adjacent to the apex 15*e* formed by the common edge of flanges 15*b* and 15*c*, the inner end of pivot pin 16 is mounted so that one end of pivot pin 16 is fixed with respect to its bracket 15 and pin 16 is perpendicular to web 15*a*. The pivot pins, such as pin 16, of each bracket, such as bracket 15, is a hollow cylindrical tube which is fastened by its proximal end to the apex portion of web 15*a*. The pivot pin 16 is, thus, closely adjacent to the apex 15*e* formed by the abutting proximal ends of flanges 15*b* and 15*c*. Pin 16 is sufficiently long that it protrudes through one of the holes 14 in the stringer 10, so that the bracket 15 is flat against inner surface 10*b*. A rivet or bolt 16*a*, which passes through washer 16*b*, extends into and is frictionally or threadedly held by the distal end portion of the pivot pin 16. Thus, each pivot pin 16 in a left hand bracket is rotationally retained in a hole 14. The stringer 20 is provided with holes, similar to holes 14, receiving pivot pins, similar to pins 16, protruding from similar but right hand brackets 25 and having rivets 26*a* and washers 26*b* similar to rivets 16*a* and 16*b*.

When the kit is produced at the factory, standard width steps or treads 35 of different prescribed lengths are produced and standard width risers 36 of different lengths are produced such that all of the treads 35 and all of the risers 36 for a particular kit are of the same width and length. The treads 35 receive bolts or screws 30, inserted from the back side of the step assembly which are passed through standard holes 31, formed in the flanges 15*b*. Since the risers 36 are always in the same positions, preformed holes 32 may be provided in the side edge portions of risers 36 for receiving bolts or screws 33 which are passed through holes 34 in flanges 15*c* and into the holes 34.

According to the first embodiment of the present invention, a control rod or bar 40 is provided with each kit for use in simultaneously pivoting all brackets, such as bracket 15, on stringer 10 or 20. This control rod 40 is a rigid, straight, usually rectangular, rod provided, at equally spaced intervals, with cantilever mounted, parallel pins or fingers 41, the spacing of the axes of the fingers 41 corresponding to the spacing of the axes of the pivot pins 16. In other words, the axis of each finger 41 is perpendicular to rod 40 and is spaced from the axis of the next adjacent finger 41 by a distance d which is equal to the distance D between the axes of adjacent pivot pins 16 when installed on a stringer 10 or 20.

Figure 6:
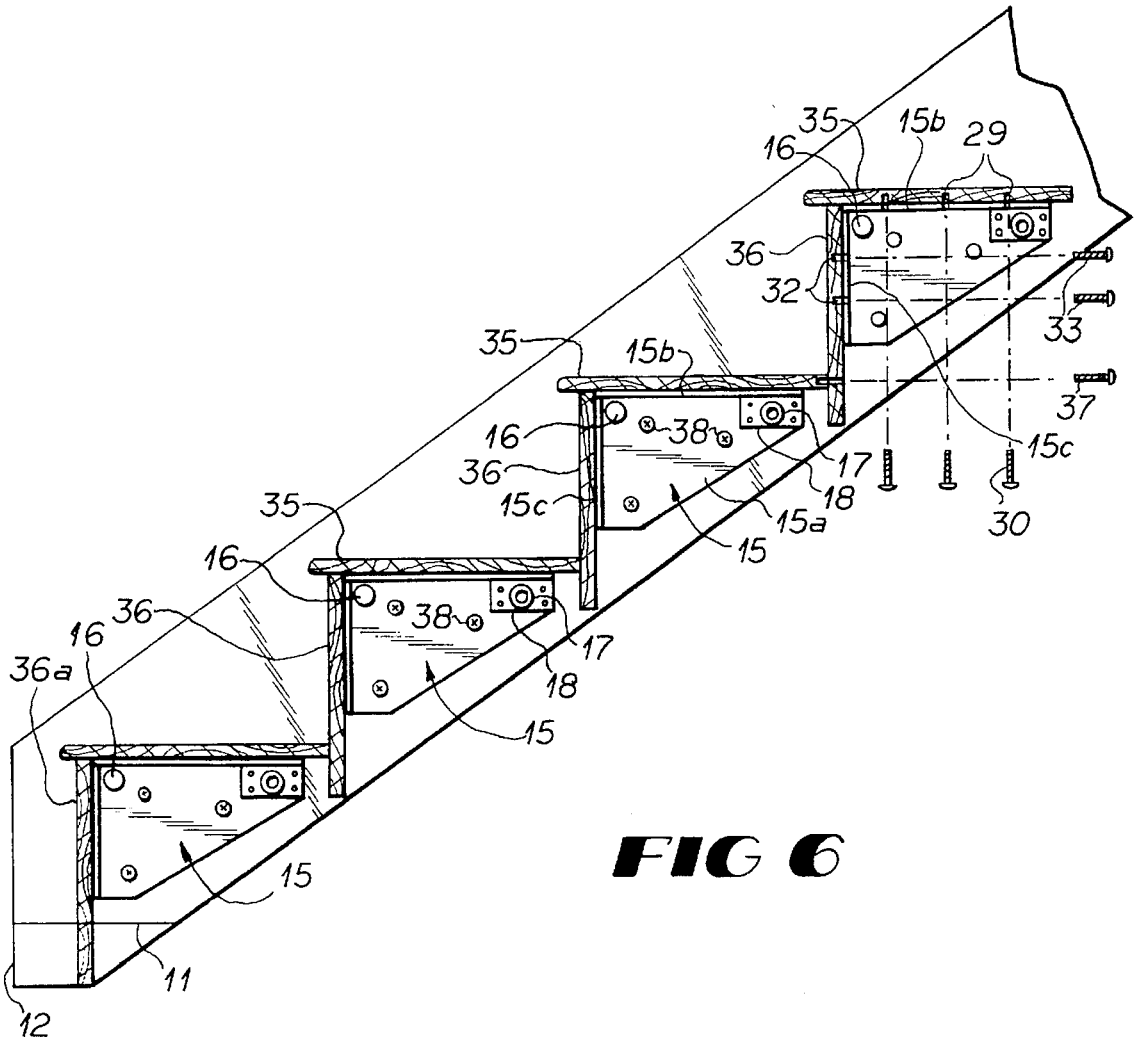
FIG. 6 is a vertical sectional, partially exploded, view taken substantially along line 6—6 in FIG. 1 and showing a portion of the stairwell in broken lines.

For respectively temporarily receiving the pins 41, the brackets 15 are respectively provided with annular cylindrical sockets 17, best seen in FIG. 3. As seen best in FIG. 6, the proximal end of each socket 17 has a flat rectangular base 18 mounted on web 15*a* and from which the socket 17 protrudes in cantilever fashion. The axes of these hollow cylindrical sockets 17 are offset by the same amount from and parallel to the axes of the pivot pins 16. The base 18, in turn, is welded flat or formed against the inside surface of the web 15*a* immediately below the distal end of flange 15*b*.

It will be understood that a kit containing the parts for the stair will include the complimentary left hand and fight hand stringers 10 and 20 which carry the individually rotatable, spaced, pivotally mounted, complimentary brackets, such as bracket 15, disposed at equally spaced intervals along the length of each the inner surfaces of stringer 10 and 20. There are, of course, left hand brackets, such as bracket 15 of the first embodiment, and fight hand brackets which are not shown. They are disposed in spaced relationship to each other so that the axes of pivot pins (not shown) of the right hand stringer 20 are respectively opposed to and aligned with pivots pin 16 of the left hand stringer 10 when the stair system is appropriately installed. Rivets or bolts 26 protruding through washer 27 retain the pivot pins of the brackets on the stringer 20.

In the first embodiment of the present invention the distance D between the axes of the pivot pins, such as pin 16, is about 12 inches, namely 12.04 inches. This permits an adjustment of the angle of the brackets, such as bracket 15, through about 6° to provide a rise of between about 7 inches and about 8 inches for the assembled stair.

The first embodiment has a triangular structure such that the line D between the pivot pins 15 is a constant 12.04 inches. The rise r and run R of the stair are the other two sides of the triangle. Even though the arms which form the triangle will vary in effective lengths, the triangle is a right triangle. The two flanges 15*b* and 15*c* of adjacent brackets 15 form the sides of the triangle. Since brackets 15 will be simultaneously pivoted by rod 40 to angular positions where they are to be fixed to the stringer, the riser flanges 16*c* of all brackets 15 remain perpendicular to the tread flange 16*b* of all brackets 15 so that the tread flange 15*b* extends rearwardly and the riser flange extends downwardly from the apex.

Given different and somewhat varying parameters for the rise r and runs R, the stair system of the preferred embodiment has a minimum rise r of 7 inches with a maximum run R of 9.8 inches and a maximum rise r of 8 inches with a minimum run R of 9 inches. As the rise r increases from 7 inches to any increment up to 8 inches, the run R progressively decreases. This is so because the hypotenuse D remains constant, always at about 12.04 inches and the brackets point outwardly such that each bracket has a horizontal flange 15*b* protruding horizontally rearwardly from the apex and a riser flange 15*c* protruding vertically downwardly from the apex.

When the stair of the first embodiment is packaged as a kit, the package includes: (1) the stringers 10 and 20 with pivoting brackets, such as bracket 15, attached; (2) the control bar 40. This control bar 40 is used only in the initial adjustment of the brackets 15 on the stringers 10 and 20 before the system is completed; (3) the treads 35, preferably 10¾ inches wide, which allow for an overhang of 1¾ inches with the minimum 9 inches run and an overhang of 15/16 inch with a maximum 9.8 inches run. The length of treads 35 and risers 36 is determined by the width of the stairwell; (4) the risers 36, which are preferably 8 inches wide, and are arranged to be behind the treads so that if the rise is less than 8 inches, the riser 36 will hang down below the tread 35. The bottommost riser 36 will later need to be ripped to size, to fit against floor 50; (5) rivets 16*a* and 26*a*; (6) washers 16*b* and 26*b*; (7) screws or bolts 30, 33 and 37; and (8) an instruction manual.

The instruction manual should have two tables, such as Table I and Table II, below:

TABLE I

NUMBER OF RISE CHART

| No. of Rises | Height Allowed for 7" Minimum Rise | Height Allowed for 8" Maximum Rise |
|---|---|---|
| 1 | 7" | 8" |
| 2 | 14" | 16" |
| 3 | 21" | 24" |
| 4 | 28" | 32" |
| 5 | 35" | 40" |
| 6 | 42" | 48" |
| 7 | 49" | 56" |
| 8 | 56" | 64" |
| 9 | 63" | 72" |
| 10 | 70" | 80" |
| 11 | 77" | 88" |
| 12 | 84" | 96" |
| 13 | 91" | 104" |
| 14 | 98" | 112" |
| 15 | 105" | 120" |
| 16 | 112" | 128" |
| 17 | 119" | 136" |
| 18 | 126" | 144" |
| 19 | 133" | 152" |
| The 7"–8" rise range will not work for the following height ranges: | | |
| | 8" | 14" |
| | 16" | 21" |
| | 24" | 28" |
| | 32" | 35" |
| | 40" | 42" |
| | 48" | 49" |

TABLE II

| RISE/RUN CHART* | | |
|---|---|---|
| Rise | Decimal Equivalent | Run |
| 7" | 7.0 | 9.8 |
| 7 1/32" | 7.031 | 9.77 |
| 7 1/16" | 7.062 | 9.75 |
| 7 3/32 | 7.093 | 9.73 |
| 7 1/8 | 7.125 | 9.7 |
| 7 5/32 | 7.156 | 9.68 |
| 7 3/16 | 7.187 | 9.66 |
| 7 7/32 | 7.219 | 9.64 |
| 7 1/4 | 7.25 | 9.61 |
| 7 9/37 | 7.281 | 9.59 |
| 7 5/16 | 7.312 | 9.56 |
| 7 11/32 | 7.344 | 9.54 |
| 7 3/8 | 7.375 | 9.52 |
| 7 13/32 | 7.406 | 9.49 |
| 7 7/16 | 7.437 | 9.47 |
| 7 15/32 | 7.469 | 9.44 |
| 7 1/2 | 7.5 | 9.42 |
| 7 17/32 | 7.531 | 9.39 |
| 7 9/16 | 7.562 | 9.37 |
| 7 19/32 | 7.593 | 9.34 |
| 7 5/8 | 7.625 | 9.32 |
| 7 21/32 | 7.656 | 9.29 |
| 7 11/16 | 7.687 | 9.27 |
| 7 23/32 | 7.719 | 9.24 |
| 7 3/4 | 7.75 | 9.21 |
| 7 25/32 | 7.781 | 9.19 |
| 7 13/16 | 7.812 | 9.16 |
| 7 27/32 | 7.844 | 9.13 |
| 7 7/8 | 7.875 | 9.11 |
| 7 29/32 | 7.906 | 9.08 |
| 7 15/16 | 7.937 | 9.05 |
| 7 31/32 | 7.969 | 9.03 |
| 8 | 8.0 | 9.0 |

*The term "rise" as used herein means the vertical distance between one tread 35 and the next tread 35. The term "run" is the width of each tread 36, excluding its overhang.

The basic steps for assembling of the stair system of the first embodiment are as follows:

(1) The floor-to-floor dimension is taken. This dimension is then located in Table; I, the Number of Rises columns. If more than one set of number of rises can be used, calculated, all to determine which will best suit the conditions. No more than 3 different rise conditions will ever be present;

(2) After deciding which rise/run will work best, put control bar 40 in the sockets 17 of brackets 15 and pivot all brackets 15, with a square resting on the top surface of flange **15*b* of one bracket 15 and resting against the surface of flange 15*c* of the next adjacent bracket 15. Pivot until a reading of the vertical scale of a carpenter's square indicates the appropriate rise distance between the surfaces of flanges 15*b* of the adjacent brackets 15**;

(3) Secure brackets 15 by bolts 38 to the stringer 10, and remove the control arm 40 from sockets 17;

(4) Make the cut for the top edge 52 using a square on the tread flange **15*b* of the uppermost bracket 15 by drawing a line perpendicular to the flange 15*b* allowing for the appropriate overhang for tread 35 as it abuts the upper floor 51**;

(5) Make the line for bottom edge 11 by using a square placed against the flange **15*c* of the bottom bracket 15** so as to provide the same rise r as the other rises;

(6) Cut vertical edge 12, perpendicular to edge 11;

(7) Produce the corresponding cuts on stringer 20 to provide edges 66, 61 and 62;

(8) Cut the treads 35 and risers 36 to the proper length. Remember the bottom riser must be ripped to size also;

(9) Attach the risers 36 to the opposed bracket 15;

(10) Attach the treads 35 to the brackets 15;

(11) Attach the risers 36 to the treads 35;

(12) Set stair up in place securing the stringers 10 and 20 to the walls, such as wall 52.

A better understanding of the present invention will be had by reference to the following; examples:

EXAMPLE I:

Given 107¼", floor 50 to floor 51 vertical height, look at TABLE I RISE CHART to see where 107¼" height is. It is in the 14 rise or 15 rise range. Take 107¼ dimension and divide by 14. This equals 7.66" for each rise. Looking at TABLE II RISE/RUN CHART which shows that 7.66 falls in the 7 21/32 rise with a 9.29" run. The stair brackets, such as bracket 15 are set by manipulation of the rod 40 so that the vertical distance between surfaces of flanges **15*b* will be a 7 21/32 rise. The run will therefore automatically be 9.29". To find the overall horizontal run, multiply [9.29×(the number of risers 12**)]+10.75=minimum allowable horizontal run to the front edge of bottom tread to back edge of the top tread. (e.g., 9.29×12=111.48+10.75=122.23"). The same calculation is made for 15 risers 7.15" rise/9.68" run; 136.59" overall horizontal run.

EXAMPLE II:

If split flights are involved, the overall heights should be divided out first and then the rise and run utilized to locate the intermediate landings.

When appropriately installed, the front edges 12 and 62 abut lower base boards 53 and 54, and the upper edges 56 and 66 of stringers 10 and 20 abut the base boards 57 and 58, whereby the inner edge of the topmost tread 35 abuts and is co-planar with upper floor 51. The lower portion of edges 56 and 66 abut the joist 59.

Figure 7:
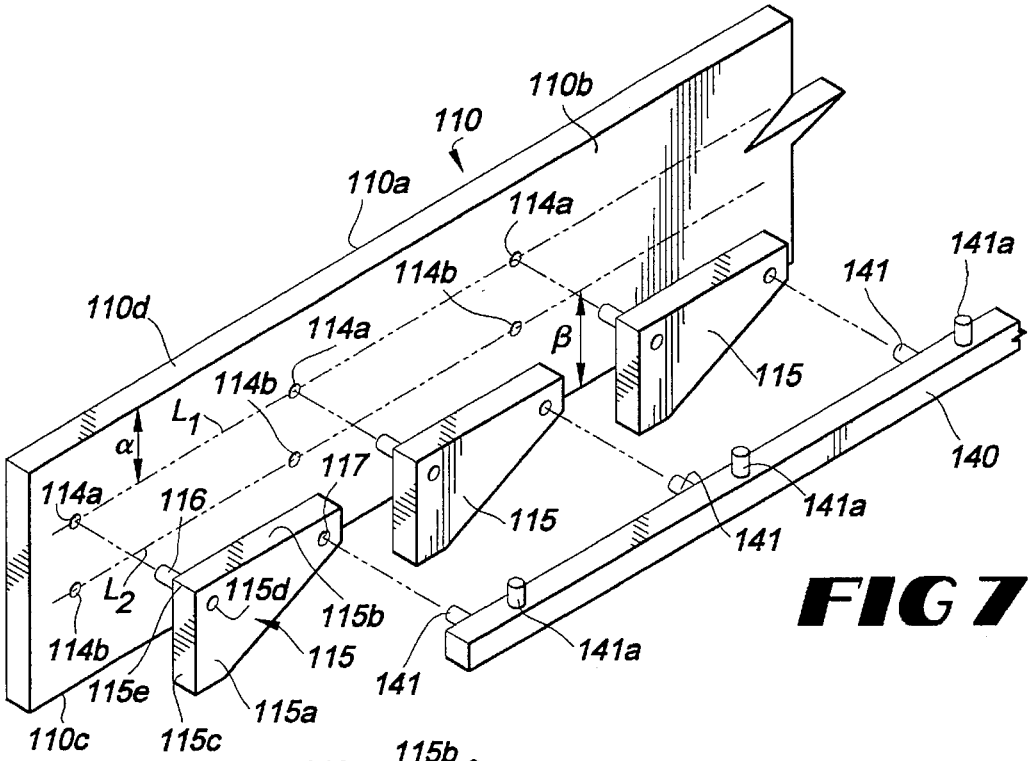
FIG. 7 is a fragmentary exploded perspective view of a portion of a second embodiment of the present invention.
Figure 9:
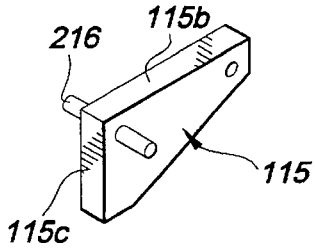
FIG. 9 is a perspective view of a modified form of a bracket of the second embodiment and showing the pivot pin protruding in both direction from the bracket.
Figure 8:
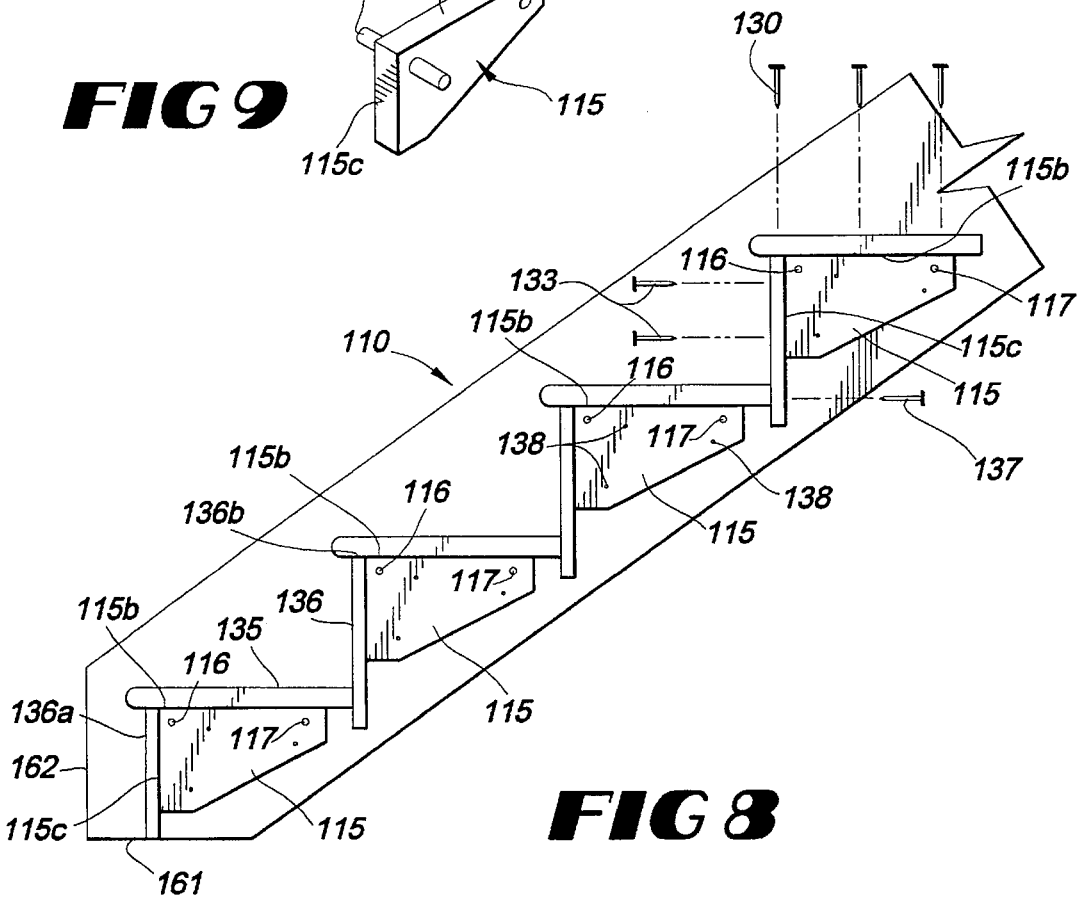
FIG. 8 is a vertical sectional view of a portion of the assembled second embodiment of the present invention, showing the screws exploded therefrom.

The second embodiment as illustrated in FIGS. 7, 8 and 9 shows a construction of the present invention which can be made essentially entirely of wood products, except for the screws or bolts 130, 133 and 137, shown in FIG. 8. In more detail, the kit of the second embodiment includes a pair of flat, rectangular, symmetrical stringers, such as stringer 110, which may function either as a left hand stringer or a right hand stringer. This stringer 110 is preferably made from plywood, having a paint surface on one side and a stain surface on the other. In other words, the stain surface may be formed as one outer layer to provide surface **110*a* and the paint surface may be formed as the other outer layer to provide surface 110*b*. Both surfaces 110*a* and 110*b* are flat and parallel to each other. Each stringer 110 is provided with a row, set or series of equally spaced pivot holes 114*a* which are arranged along a straight line $L_1$ at a distance $\alpha$ from one edge 110*d* of the stringer 110. In like fashion, a row, series or plurality of lower pivot holes 114*b* are provided along a line $L_2$, each hole being a through hole and each hole being an equal distance from the next adjacent hole 114*b*. The line $L_2$ is at a distance $\beta$ from the lower edge 110*c* of the stringer 110. Both distance $\alpha$ and distance $\beta$ are equal. The space between Line $L_1$ and line $L_2$ is approximately 2 inches. The holes 110*a* are distance from each other of approximately 12.04 inches. The apex of holes 114*b* are preferably spaced a distance of 11.876 inches from each other so that each adjacent pair of holes 114*a*, 114*b*, will be in close to, but not exactly in vertical alignment with each other. Other rows of aligned holes (not shown) may be provided in the stringer 110, as desired. Indeed, these holes may be spaced a shorter distance or a longer distance from each other than the preferred 12.04 inches or 11.876 inches. The spacing between adjacent holes 114***a* or 114*b*, as the case may be, defines the hypotenuse of a step.

For cooperating with the stringer 110, there are a plurality of tread/riser support brackets 115, seen in FIGS. 7 and 8. These support brackets 115 are generally triangular in shape and are preferably formed from wood, plywood or particle board. Each bracket 115 is preferably about ¾ inch thick to about 1½ inches thick and preferably 1 inch thick, and is cut so as to provide a generally triangular body 115, provided with a flat tread support surface 115*b* and a flat riser support surface 115*c*. The tread support surface 115*b* is disposed 90° from riser support surface 115*c*. Their proximal ends abut at the apex 115*e*. The surface 115*b* forms a relatively long surface support while the riser support 115*c* is in a plane perpendicular thereto.

Each bracket 115 is provided with a hole 115*d* which is in the apex portion of bracket 115, adjacent to the apex 115*e* of block 115. This hole 115*d* is about ¾ inch distance from the riser support surface 115*c* and the tread support surface 115*b*. Adapted to be received within the hole 115*d* and protruding sidewise therefrom is pivot pin 116. Preferably this pivot pin 116 is formed of wood, such as dowel pin stock, and protrudes perpendicularly away from the inner surface of the bracket 115 so as to be received in one of the holes 114*a* or 114*b*.

In FIG. 9, a modified form of pivot pin 216 is shown as protruding outwardly from both side surfaces of the body 115*a* so that the bracket 115 can be used either as a left hand bracket or as a right hand bracket.

It is important, according to the present invention, that the bracket 115, when mounted on the stringer 110 by pin 116 or 216, dispose the bracket 115 so that the tread supporting surface 115*b* extends, from pin 116 or 216, rearwardly of the stair while the riser supporting surface 115*c* extends in a downwardly direction. Thus, the bracket 115, which has the pivot pin 216 can be used on either side of the stringer 110, as required, whereas the brackets 115 shown in FIGS. 7 and 8 have the pivot pins 116 which, as illustrated, form only the left hand brackets. It will be understood that when the brackets 115 are used for a fight hand stringer, the pivot pins 116 be mounted so that the pivot pins 116 now protrude from the hole 115*d* in an opposite direction from that illustrated in FIG. 7. Therefore, when the stringers 110 and the brackets 115 are supplied in kit form, the pivot pins 116 are to be supplied cut to length, but not inserted in either end of the hole 115*d*. The person assembling the kit can select on which side of the bracket 115 to use the pivot pin. Once this is selected, the pivot pins 116 should be glued in place in the holes 115*d*.

Immediately below the distal end portion of the tread support 115*b* the body of the bracket 115 is provided with a hole 117 which is for the purpose of permitting simultaneous adjustment of several brackets 115.

Included in the kit of the second embodiment is a straight, rigid rod 140 which is about the same length of the length of the stringer 110. This rod 140 is provided with a plurality of equally spaced, sidewise protruding control pins or fingers 141, the spacing of the axes of the control fingers 141 corresponding to the spacing of the axes of the holes 114*a*, and hence, the spacing of the axes of the pivot pins 116, when the brackets 115 are to be positioned. The fingers 141 extend from one surface of the rod 140 and are to be temporarily received, respectively, in successive holes 117 of successive brackets 115 so that manipulation of rod 140 simultaneously pivots brackets 115.

Arranged to protrude from another surface of the rod 140 are a plurality of second pins 141*a*. The spacing of these second control pins 141*a* correspond to the spacings between the holes 141*b*.

When the brackets 115 are rotatable mounted by pins 116 along one surface of the stringer 110, and the pins 116 protrude into upper holes 114*a*, the angled brackets 115 are simultaneously adjusted to rotated positions in a manner as described above for the brackets 15. When, however, the pivot pins 116 of the brackets 115 are inserted respectively in the holes 114*b*, the rod 140 is to be manipulated so that the control fingers 141*a* are respectively received in the holes 117 of the brackets 115.

In the preferred embodiment of the present invention, the holes 114*a* are spaced apart along line $L_1$ by 12.04 inches while the holes 114*b* are spaced apart along line $L_2$ by 11.1876 inches.

The stringers 110 can be supplied in modular lengths so that one stringer 110 can abut the next, etc. Preferably these stringers 110 are provided in lengths so that there are four, eight, twelve or twenty holes 114. The supplied length for the stringers 110 is preferably such that the ends of the risers can be arranged end to end so as to provide a continuous length of properly spaced holes 114*a* and/or 114*b*. Of course an appropriate strap (not shown), such as a board, can be nailed to join the two lengths of risers 110 together.

When the holes 114*a*, which are 12.04 inches apart, are used to support the pins 116, this will provide a rise of 8 inches and a run of 9 inches. When, however, the holes 114*b*, which are 11.876 inch apart, this will provide a 7¾ inch rise and a 9 inch run.

When the two stringers 110 are arranged at an incline in a stairwell, and the bottom is appropriately cut to provide front edges, such as edge 162 and bottom edge, such as edge 161, shown in FIG. 8, the brackets 115 can then be mounted with pins protruding through the holes 114*a* or 114*b*, as the case may be. The rod 140 is then employed to manipulate all brackets 115 so that the tread supporting surfaces 115*b* of all brackets 115 are arranged in horizontal positions. Thereafter, nails, screws or other fasteners 138 are driven through the brackets 115 and into the stringers 110 so as to fix the position of all brackets 115.

Brackets 115 are required to have the horizontal tread supporting surfaces 115*b* extending from the apex rearwardly into the stairwell and the riser supporting surfaces 115*c* thereof, extending vertically, downwardly from the apex. In installing the treads 135 and risers 136, 136*a*, the treads 135 and the risers 136, 136*a* should be cut to appropriate length to be supported on opposed pairs of brackets 115. One should preferably start at the bottom, install the riser 136*a* for the bottommost step, after ripping it to appropriate height, as illustrated in FIG. 8, the riser 136*a* being nailed in place against the downwardly extending surfaces 115*c* of the opposed brackets, such as bracket 115. Next, the step or tread 135 is installed using nails or screws 130. This installation is continued in an upward direction so that nail or nails 137 secure each appropriate riser 136 against the rear edge of the tread 135. The risers 136, which are installed need not be mooed to height since their lower portions are to be behind and abut the rear of the tread 135, therebelow. The upper edges 136*b* of all risers 136 terminate in the common horizontal plane of the tread supporting surface 115*b* of its opposed brackets 115 and abut the flat surface of a tread 135. Nails, screws or fasteners 133 secure risers 136 in placed against the risers supporting surfaces 115*c*. The flat tread 135 is preferably about 10¾ inches wide and 1 inch thick. The riser 136 is preferably about 8 inches and is made of ¾ inch board.

It will be obvious to those skilled in the art that many variations may be made in the embodiment here chosen for the purpose of illustrating the present invention without departing from the scope thereof as defined in the appended claims.

I claim:

1. A stringer system for a stair comprising:

(a) a stringer having a flat surface and provided with a plurality of holes having equally spaced axes, said axes being disposed generally in longitudinal alignment with each other along a prescribed straight line;

(b) a plurality of brackets respectively having individual webs being received adjacent to said surface and having individual tread support surfaces;

(c) pivot pins mounted to said brackets, said pivot pins having axes spaced a prescribed equal distance apart from each other, said pivot pins being respectively received in said holes and respectively connected to said brackets so that each bracket may pivot about its pivot pin in a plane parallel to said flat surface to various angular positions with respect to said straight line;

(d) said brackets being respectively provided with sockets having axes respectively spaced from the axes of the pivot pins of these brackets by said prescribed distance;

(e) a control rod;

(f) a plurality of fingers protruding from said control rod, said fingers having axes perpendicular to said rod and spaced from each other by a distance approximately equal to said distance between the axes of said pivot pins, said fingers being received respectively in said sockets for simultaneously moving said brackets on said stringer about the axes of their respective pivot pins, so as to simultaneously pivot said brackets such that all of said tread support surfaces are simultaneously disposed at the same angular positions with respect to said straight line;

(g) said fingers being removable from said sockets by movement of said rod after said angles positions of said brackets have been set.

2. The stringer system defined in claim 1 wherein said brackets include individual riser support surfaces respectively perpendicular to said tread support surfaces and intersecting said tread support surfaces to form individual apexes and wherein said pivot pins, respectively, are closely adjacent to said apexes.

3. The stringer system defined in claim 2 wherein said system includes detent means installed between each of said brackets and said stringer preventing further pivoting of said brackets.

4. The stringer system defined in claim 1, wherein each of said brackets has a riser support surface.

5. The stringer system defined in claim 1, further comprising detent means fastening said brackets to said stringer after said brackets have been adjusted to their desired positions.

6. The stringer system defined in claim 1, wherein said sockets are removable.

7. A stair system comprising:

(a) a pair of flat stringers having opposed surfaces provided with a plurality of equally spaced aligned pairs of holes, respectively having axes, said axes in each stringer being disposed generally in alignment with each other along a prescribed straight line on each stringer, said axes being spaced from each other by a prescribed distance;

(b) a plurality of brackets having webs received against said opposed surfaces of said stringers and tread supporting flanges protruding from said webs;

(c) pivot pins provided with axes and respectively received in said holes and connected to said brackets providing opposed pairs of brackets on said stringers when said stringers are disposed in a stairwell, the axes of said pivot pins being spaced apart by said prescribed distance, said brackets being rotatable about the axes of said pivot pins to angular positions with respect to said straight line;

(d) said brackets being respectively provided with sockets, each being spaced from the pivot pin of that bracket by a selected distance;

(e) a control rod;

(f) a plurality of fingers protruding from said control rod, said fingers having axes spaced from each other by a distance approximately equal to said prescribed distance between the axes of said pins, said fingers received respectively in said sockets for simultaneously pivoting said brackets on one of said stringers about the axes of their respective pivot pins, such that all of said tread supporting flanges on either of said stringers are simultaneously disposed at the same angular positions with respect to said straight line;

(g) means fixing said brackets in said angular positions; said fingers of said control rod being readily removable by said rod from their sockets; and (h) treads for extending between the tread flanges of the opposed pair of brackets on said stringers.

8. The stair system defined in claim 7 wherein said brackets are right angular brackets, including riser supporting surfaces respectively perpendicular to said tread supporting flanges, said riser supporting surfaces and said tread supporting flanges forming apexes and said pivot pins being adjacent to said apexes and including risers supported by said riser supporting surfaces.

9. The stair system defined in claim 8 wherein said risers have lower portions disposed behind said treads.

10. The stair system defined in claim 7 wherein the distance between the axes of said pivot pins is approximately 12 inches.

11. The stair system defined in claim 9 wherein the assembled stair is adjustable to provide between about a 7 inch rise to about an 8 inch rise.

12. A stair system comprising:

(a) a pair of opposed unitary stringers;

(b) a plurality of opposed pairs of equally spaced angular shaped brackets at spaced positions along said stringers, each of said brackets having surfaces generally perpendicular to each other and an apex fixing positions of said surfaces;

(c) pivot pins passing respectively through said apexes of said brackets and about which said brackets are respectively rotatable with respect to said stringer; said pivot pins each being in a fixed location to provide opposed pairs of pivot pins, respectively on said stringers;

(d) means for respectively fixing all of said brackets in prescribed positions on said stringers disposing one of said surfaces of each of said brackets horizontally and the other of said surfaces of each of said brackets vertically;

(e) a plurality of treads supported in vertically spaced relationship by horizontal disposed surfaces of opposed pairs of said brackets, said brackets having a top surface and a bottom surface;

(f) a plurality of risers supported by vertical disposed surfaces of opposed pairs of the brackets, said risers each having an upper edge and a lower portion; and (g) the risers on certain opposed pairs of brackets being respectively flush with the bottoms of the treads on those opposed pair of brackets and the lower portions of certain of said risers terminating behind the next lower of said treads.

13. The stair system defined in claim 12 wherein said risers have lower portions and said treads have rear portions, said pivot pins being equally spaced apart so that the lower portions of certain of said risers are disposed respectively behind said rear portions of certain of said treads.

14. A process of producing a stair system for mounting in a stairwell between floors, a height between floors being a fixed distance comprising the steps of:

(a) pivotally mounting, on a pair of flat one piece stringers, a plurality of right angular brackets having apexes and surfaces in each bracket disposed at approximately a right angle to each other and converging toward its apex, each bracket being arranged to pivot to angular positions about its apex on its stringer and having a surface spaced from its apex;

(b) adjusting the angular position of each bracket according to the distance between floors at the stairwell in which the stair system is to extend and be mounted;

(c) rotating each bracket to an angular position on its stringer in which one of said surfaces in each bracket is horizontally disposed and extends from said apex rearwardly of said stair system and the other of said surfaces is vertically disposed and extends downwardly from said apex;

(d) fixing the angular position of each of said brackets with respect to its stringer to fix the angular position of each bracket so as to maintain horizontal and vertical positions of said surfaces;

(e) supporting treads having end portions by their end portions on opposed pairs of said horizontal surfaces; and (f) supporting risers having upper edges, lower portions and end portions so that they are supported by their end portions on opposed pairs of said vertical surfaces and so that the treads overhang the upper edges of certain of said risers and abut the lower portion of other of said risers.

15. The process defined by claim 14 wherein said stringers have first ends and second ends, and wherein the first ends of said stringers are cut along lines perpendicular to planes of said horizontal surfaces of said brackets after the angular positions of said brackets are fixed.

16. The process defined in claim 15 wherein said second ends of said stringers are cut along lines perpendicular to the horizontal surfaces of said brackets.

17. The process defined in claim 14 wherein said brackets have sockets and wherein the step of adjusting the angular position of each bracket manually includes holding a rod having equally spaced fingers and inserting the fingers respectively into said sockets on said brackets on one stringer and moving said rod for simultaneously rotating those brackets.

18. A stringer assembly of a stairstep system comprising:

a one piece stringer having a flat inner surface and a pair of parallel straight edges;

(b) a plurality of equally spaced pivot pins carded in fixed positions by said stringer, said pivot pins respectively having axes which are aligned with each other and equally spaced from each other along a straight line parallel to and between said edges;

(c) a plurality of rotatable brackets respectively on said pivot pins, each of said brackets being rotatable about the axis of its pivot pin, each of said brackets being an "L" shaped member having an apex and a fixed pair of arms diverging from said apex at a prescribed and fixed angle to each other enabling movement along the surface of said stringer when that bracket is rotated, said brackets each having a tread supporting surface on one of said arms and a riser supporting surface on the other of said arms, said surfaces being in a fixed relationship to each other and disposed so that said one surface is generally perpendicular to said other of said surfaces enabling simultaneous movement by said bracket when said bracket is rotated along the surface of said stringer, and so that one surface will extend rearwardly from said apex and the other surface downwardly of said apex when installed as part of said stairstep;

(d) at least one of said arms of each bracket being of a length such that it has a portion which is spaced from its apex that is normally within said edges of said stringer and will be moved along the surface of said stringer when said bracket is rotated; and (e) detent means for cooperating with said portion fixing the position of its bracket in a prescribed position on said surface of said stringer and so that its bracket is thereafter supported by its pivot pin and by said detent means in a fixed position within said stringer.

19. The assembly of claim 18 including an additional stringer, and additional brackets on said additional stringer in opposed relationship to said one piece stringer and its brackets.

20. The assembly of claim 19 including treads between and supported by opposed brackets on said one piece stringer and said additional stringer.

21. The assembly of claim 20 including risers carried by opposed pairs of said brackets, certain of said risers extending between said treads so as to have a portion of one of said risers behind one of said treads and a portion thereof beneath another of said treads.

22. A prefabricated stair system kit for producing a stair within a stairwell, comprising:

(a) a plurality of brackets, each having an apex portion, a flat side surface, and a pair of supporting surfaces which are perpendicular to each other and converge toward said apex portion, said supporting surfaces in perpendicular relationship to said flat side surface;

(b) a plurality of pivot pins installed in said apex portion and protruding respectively sidewise from said brackets when installed, each of said pivot pins having a proximal end which is received and fixed by said apex portion, said pivot pins having distal ends terminating in spaced relationship to the side surfaces of said brackets when installed on said brackets, said pivot pins protruding sidewise away from and perpendicular to said side surface of said bracket when installed;

(c) a pair of one piece stringers for being disposed in said stairwell at an incline on opposite sides of said stairwell, said stringers each having a flat bracket receiving surface and a first straight edge intersecting said flat bracket receiving surface, said stringers each having a first plurality of equally spaced pivot holes which pass into said flat surface, said first plurality of pivot holes being in alignment with each other along a first line parallel to and inwardly of said first straight edge of said stringer, said pivot pins, inserted into said first plurality of pivot holes permitting their respective brackets to pivot about axes of said first plurality of pivot holes such that said flat surface of each bracket passes along said flat bracket receiving surface of said stringer during its rotation, said brackets and said stringers receiving nails or screws therein so that said nails or screws fix angular positions of said brackets when said brackets have been rotated to positions in which one of said receiving surfaces of each bracket is disposed horizontally in said stairwell and extends rearwardly from said apex and the other of the receiving surface of each bracket extends vertically downwardly from said apex when said stringer is in its inclined position;

(d) a plurality of treads having flat upper and lower sides;

(e) a plurality of risers which are flat, generally rectangular members having upper edges and bottom surfaces; and (f) said stringers positioning said brackets in opposed pairs so that said brackets when installed have opposed pairs of receiving surfaces disposed in essentially horizontal positions parallel to each other and opposed pairs of said additional receiving surfaces disposed in upright positions, said opposed pairs of surfaces in horizontal positions receiving said treads and said opposed pairs of receiving surfaces in vertical positions receiving risers disposed in perpendicular positions such that the risers abut the bottom surfaces of said treads when they are installed.

23. The kit defined in claim 22 including a control rod and a plurality of control pins protruding from said control rod, said control pins being equally spaced from each other by a distance approximately equal to the spacing of said first plurality of pivot holes from each other and said brackets each having holes spaced from said pivot pins receiving the control pins of said control rod.

24. The kit defined in claim 22 wherein proximal ends of said first plurality of pivot pins are sufficiently long to pass through said brackets and protrude outwardly from both sides of said brackets and enable said brackets to be selectively received against the surface of either of said stringers.

25. The kit defined in claim 22 wherein said stringers are formed of wood and said brackets are formed of wood.

26. The prefabricated kit defined in claim 22 wherein said stringers are provided with a second plurality of equally spaced holes and said stringer is provided with a second straight edge opposite to and parallel to said first straight edge, said second plurality of holes being disposed along a line parallel to said second edge, said second line being spaced from said second edge by a distance equal to the spacing of said first plurality of holes from said first edge, said pins received in said first row of holes.

27. The kit defined in claim 26 wherein said stringers each have a first and second flat sides parallel to one another and said bracket has a second flat side parallel to said first flat side of said bracket so that said brackets are each received against either side surface of said stringer with the pivot pins of each bracket protruding into either a hole of said first plurality of holes or a hole of said second plurality of holes.

28. The kit defined in claim 22 wherein said pivot pin protrudes in both directions from said bracket and is removably received on both sides of said stringer, said stringer having a second side parallel to said first side.

29. A stairstep system for a stairwell comprising a pair of parallel, inclined stringers having opposed inner surfaces, a plurality of pairs of opposed individually rotatable brackets, each bracket having an apex portion, a tread supporting surface and a riser supporting surface converging toward said apex portion, each bracket being rotatably received by its stringer and rotatable about its apex portion, means for arresting the individual rotation of said brackets positioning said brackets with their tread supporting surfaces in horizontal position, a plurality of treads each having end portions and carded by its end portions by the tread supporting surface of an opposed pair of said brackets, and risers carried by the riser supporting surfaces of opposed pairs of said brackets.

30. Process of assembling and installing a stair system comprising the steps of:

(a) producing a plurality of substantially identical brackets, each having an apex portion, and a tread supporting edge surface and a riser supporting edge surface disposed perpendicularly to each other and converging toward said apex portion;

(b) disposing a pair of opposed stringers within a stairwell so that said stringers are in inclined parallel opposed relationship to each other;

(c) pivotally mounting said brackets on said opposed stringers so that said brackets individually pivot about opposed pivot axes in rows in spaced alignment to each other;

(d) simultaneously rotating every bracket on a stringer to a selected position in which its tread supporting surfaces are in a horizontal position and its riser supporting surfaces are in a vertical position using a control rod that detachably attaches to each bracket;

(e) fixing each bracket in its selected position on its stringer; and (f) mounting treads and risers on said tread supporting surfaces and on said riser supporting surfaces.

* * * * *